US008656933B2

(12) United States Patent
Boyd

(10) Patent No.: US 8,656,933 B2
(45) Date of Patent: Feb. 25, 2014

(54) HAIR SCULPTING DEVICE AND METHODS

(76) Inventor: Bruce T. Boyd, Dallas, TX (US)

( * ) Notice: Subject to any disclaimer, the term of this patent is extended or adjusted under 35 U.S.C. 154(b) by 201 days.

(21) Appl. No.: 12/904,463

(22) Filed: Oct. 14, 2010

(65) Prior Publication Data

US 2011/0083292 A1 Apr. 14, 2011

Related U.S. Application Data

(60) Provisional application No. 61/251,522, filed on Oct. 14, 2009.

(51) Int. Cl.
*A45D 24/16* (2006.01)

(52) U.S. Cl.
USPC ..... 132/120; 15/114

(58) Field of Classification Search
USPC ..... 132/120, 126, 142, 148; 119/616, 615, 119/612, 621; 15/114, 115
See application file for complete search history.

(56) References Cited

U.S. PATENT DOCUMENTS

| | | | | |
|---|---|---|---|---|
| 429,010 | A * | 5/1890 | Burke | 119/612 |
| 789,785 | A * | 5/1905 | Bangert | 15/114 |
| 5,285,774 | A * | 2/1994 | Stachurski | 601/137 |
| D439,414 | S | 3/2001 | Birdwell | |

* cited by examiner

*Primary Examiner* — Rachel Steitz
(74) *Attorney, Agent, or Firm* — Hemingway & Hansen LLP; D. Scott Hemingway

(57) ABSTRACT

A handheld device for sculpting hair includes a bristle section and a wave section which effectively sculpt hair in a wave style when used in the method of the invention.

14 Claims, 6 Drawing Sheets

HAIR SCULPTING DEVICE AND METHODS

CROSS REFERENCE TO RELATED APPLICATIONS

This application claims the benefit of U.S. provisional application 61/251,522 filed Oct. 14, 2009.

STATEMENT REGARDING FEDERALLY SPONSORED RESEARCH OR DEVELOPMENT

Not applicable.

TECHNICAL FIELD OF INVENTION

The present invention is directed, in general, to hair care accessories and, more specifically, to devices and methods for sculpting hair.

BACKGROUND OF THE INVENTION

Shaping or sculpting hair is a process used by persons with curly or wavy hair to provide a desired aesthetic. Various grooming devices and formulas have been used to aid this process. In one process, for creating a "wave" hair style, a user brushes or otherwise temporarily straightens hair and follows this procedure with stroking the hair with the fingers. Over time, the hair is trained to comport with the desired style.

BRIEF DESCRIPTION OF THE DRAWINGS

FIG. 3*c* is an illustration of an exemplary person's hair with hair style changing as the hair sculpting device passes through.

FIG. 3*d* is an illustration of an exemplary person's hair with hair style changed after the hair sculpting device has passed through.

DETAILED DESCRIPTION

Figure 1:
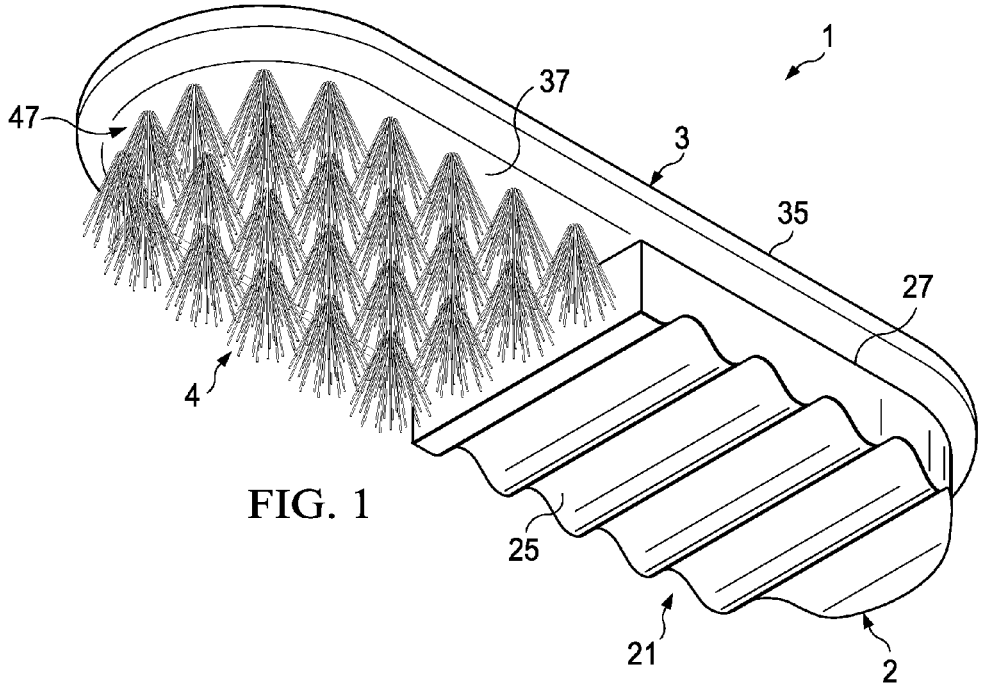
FIG. 1 is a bottom perspective view of the preferred embodiment of a hair sculpting device.

A hair sculpting device comprising a top portion having an upper surface and a bottom surface, said bottom surface having a first area and a second area, a bristle portion attached to and extending from said first area of said bottom surface of said top portion, and a groove portion attached to and extending from said second area of said bottom surface of said top portion is hereby disclosed. Methods of using said hair sculpting device are also described.

In an embodiment, the hair sculpting device is of an overall dimension permitting it to be easily held in the palm of a user's hand. A hand-held size allows for easier application of the device and portability. In another embodiment, the upper surface of said top portion may further comprise a handle extending outwardly from said upper surface. The handle is preferably of a dimension sufficient to allow a user's hand or fingers to slip between the handle and the upper surface during use. In another embodiment, the upper surface of the top portion can be provided with indentations which may be gripped by the fingers.

The proportion of said first area or bristle portion of the hair sculpting device preferably ranges from about ¼ to about ½ of the bottom surface of the top portion. The stiffness of the bristles in the bristle portion may be selected prior to manufacturing. Various hair sculpting devices with differing bristle characteristics may be made. The bristle stiffness can be adapted to better accommodate users' specific hair textures. For example, a person with coarser hair would generally prefer firmer bristles while a person with finer hair would generally prefer softer bristles. For maximum effectiveness, the stiffer bristles are preferred for the wave sculpting method. The bristle portion of the device comprises a plurality of bristle groups. Generally, a bristle group comprises about 5 to about 10 bristles. About 3-15 rows of bristle groups can be used. The number of rows is dependent on bristle group size and the dimension of the bristle portion of the hair sculpting device.

The groove portion of the hair sculpting device comprises a material block having a first surface secured to said top portion and a second hair-contacting surface having a plurality of integral grooves. The material block is preferably constructed of a durable substance which permits the grooves to be maintained but is also soft enough to be dragged along a user's scalp without causing discomfort. A suitable durable substance is a foam material. The foam material preferably is polyether or polyester based urethane polymer having a density of 0.5-15 lbs/cubic foot. Most preferably, the foam is a polyether urethane foam (EU) such as or with characteristics similar FG-65C (Hickory Springs Mfg. Co. Hickory, N.C.) with a density of around 2.2 lbs/cubic foot and a compressive strength of around 60-68 pounds per square inch. The foam should be sufficiently firm to retain the grooves necessary to train the hair during use, but to also provide flexibility for comfort as it is drawn through the hair against the scalp.

The hair styling device herein disclosed permits a user to create a wave hairstyle by employing the brush portion to temporarily straighten the hair, followed by gently dragging the groove portion over the area. The process only requires the use of one hand and provides for a more rapid wave hairstyle than previously obtainable. The preferred method of using the hair styling device is now further discussed. The hair styling device is employed by dragging it across a users' hair with the bristle portion leading and the groove portion following. Preferably, the motion begins near the top, back area or crown of the user's head and moves toward the front or down, for example a top to bottom and/or back to front motion. The hair styling device is preferably used with a pomade hair styling product or similarly functioning product applied to the hair or hair styling device prior to using the hair styling device. A stocking-like cap can be used after each hair training session to encourage the waves to set in the preferred style.

Some users will desire a style which may require more than one training session as described above. The hair styling device disclosed herein may reduce the training time required as compared with training the hair without a device. In addition, the method is consistent and provides a desirable hair styling result.

Referring to FIG. 1, the preferred embodiment of a hair styling device (1) comprises a bristle portion (4), a groove portion (2) having a top smooth surface and a bottom groove surface (25), and a top portion (3) having an upper surface (35) and a bottom surface. The device is preferably used in a motion from back to front or top to bottom. The bristle portion (4) comprises multiple bristles as commonly found on brushes. The bristle top ends (47) are secured to the first area (37) of said bottom surface of said top portion (3). The groove portion (2) comprises a single piece with multiple grooves along the bottom groove surface (25) with the top smooth surface secured to the second area (27) of said bottom surface of said top portion (3). The grooves can range from 1/10 of an inch to 1/4 of an inch, but is preferably about 1/8 of an inch. Length of bristles is preferably as long as groove portion thickness or slightly longer depending on bristle stiffness, for example, softer bristles are preferably about 1/8 inch longer than the groove portion thickness.

Figure 2:
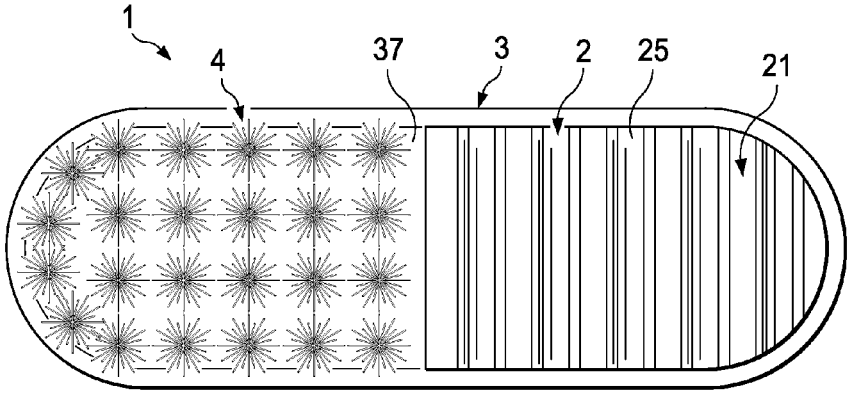
FIG. 2 is a bottom view of the preferred embodiment of a hair sculpting device.

Now referring to FIG. 2, a bottom view of the device is shown. Grooves (21) are formed in a path along the width of the device.

Figure 3A:
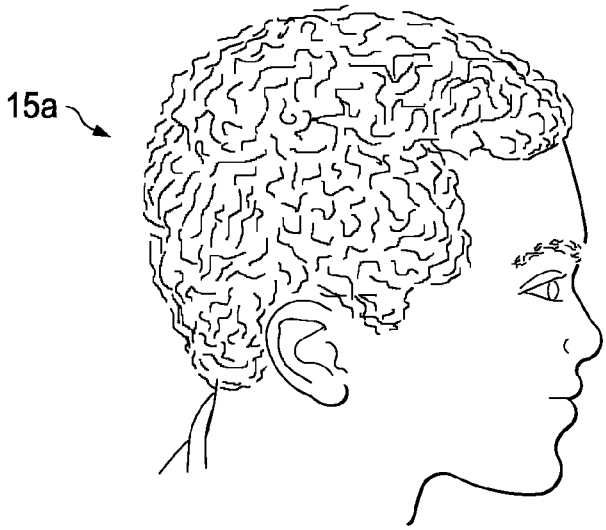
FIG. 3*a* is an illustration of an exemplary person's hair before use of the hair sculpting device.
Figure 3B:
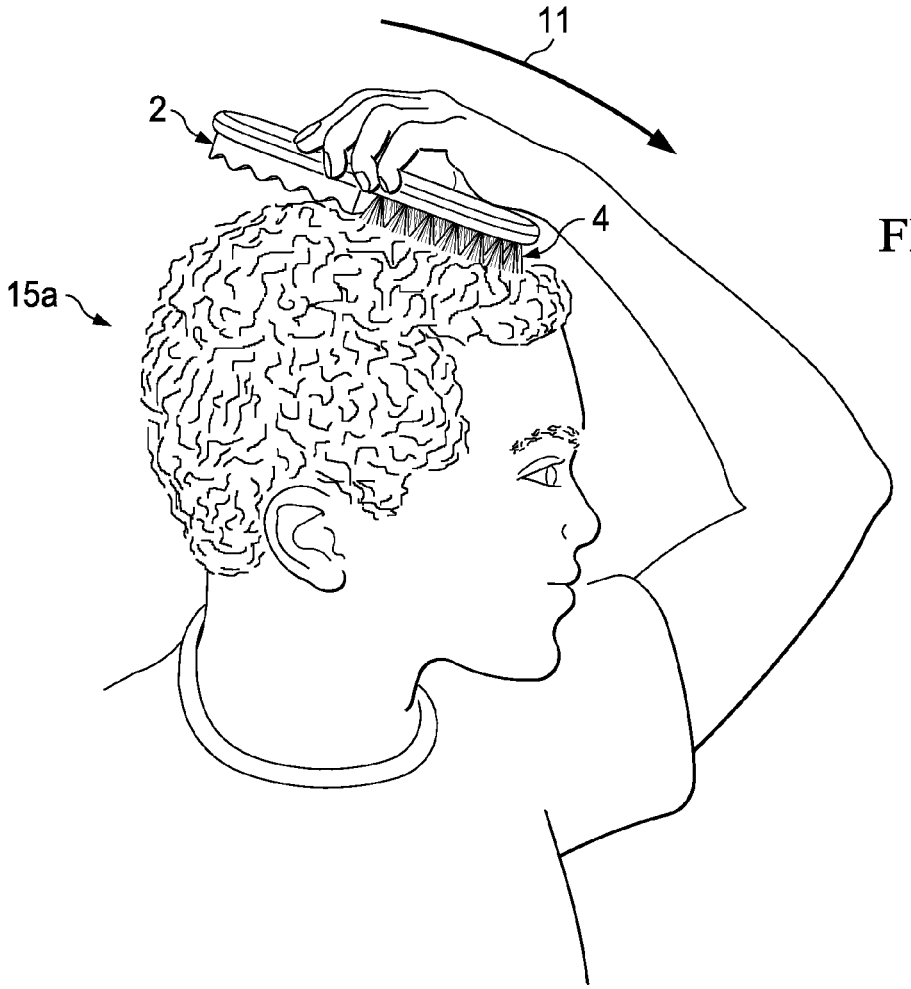
FIG. 3*b* is an illustration of an exemplary person's hair with initiation of use of the hair sculpting device.
Figure 3C:
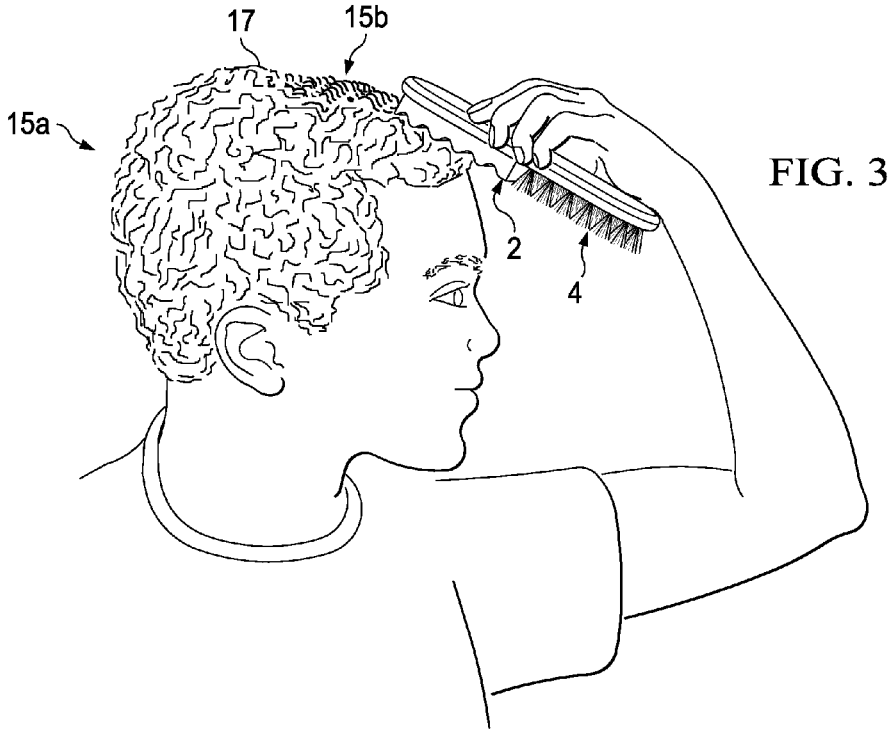
Figure 3D:
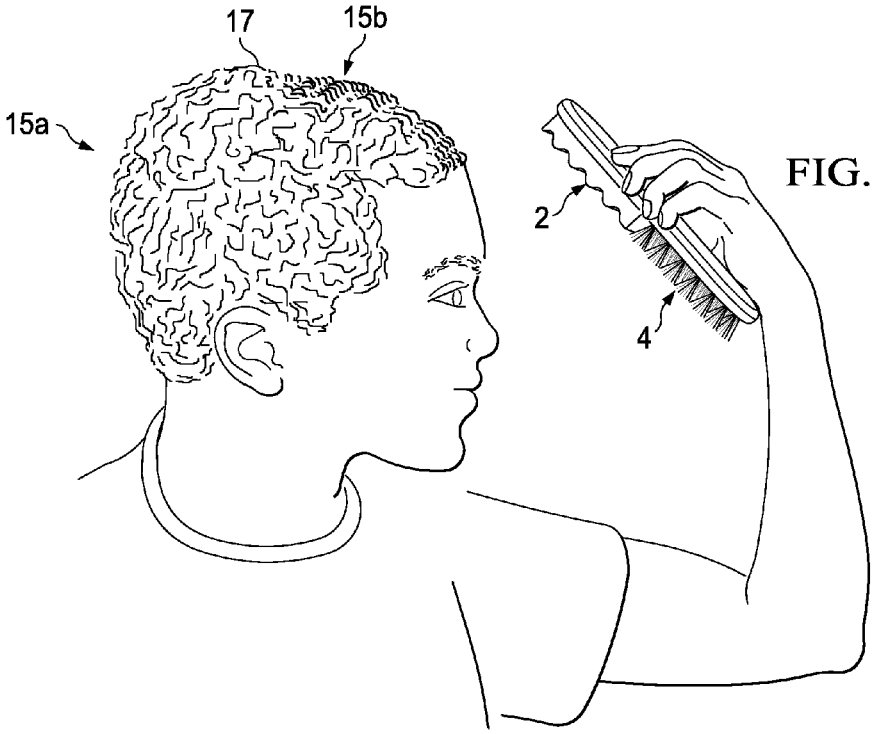
Figure 3E:
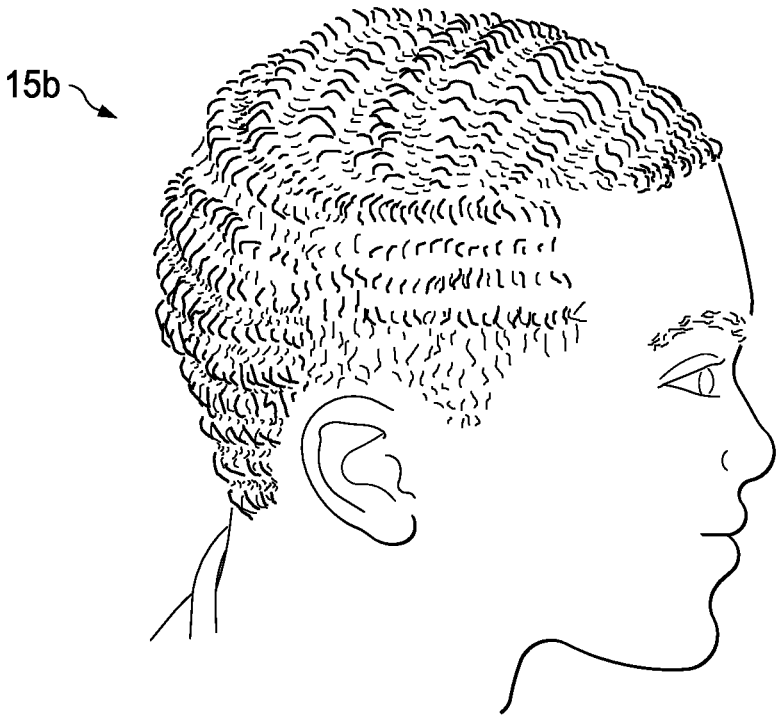
FIG. 3*e* is an illustration of an exemplary person's hair after use of the hair sculpting device.

Now referring to FIGS. 3*a*-3*e*, an exemplary person's hair before, during, and after use of the disclosed invention is illustrated. FIG. 3*a* shows an example of a person's hair in its normal state (15*a*). FIGS. 3*b* through 3*d* illustrate a user using the invention. The user places the device near the crown of his head (17) and moves the device in a back to front motion (11) or a top to bottom motion (not shown). The bristle portion (4) leads in the direction of the motion (11) with the groove portion (2) following behind the bristle portion (4). As the device passes through the user's hair, the hair is changed from the natural state (15*a*) to a wave-like state (15*b*). Multiple passes may be needed to acquire the desired look. FIG. 3*e* illustrates the look of a person's hair after use of the invention where the hair takes on the wave-like state (15*b*).

Figure 4:
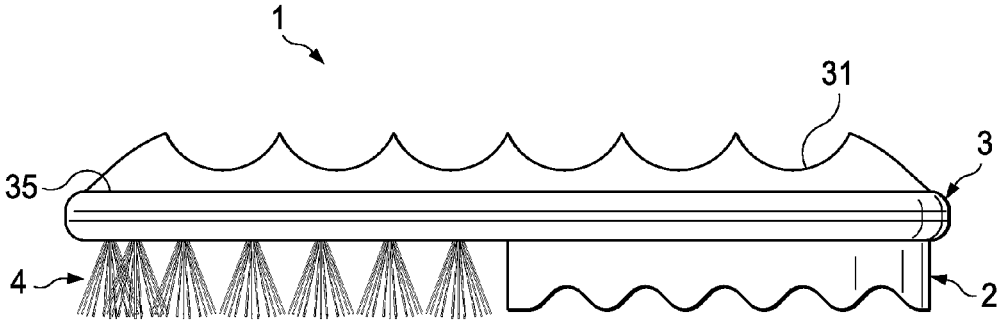
FIG. 4 is a side view of another embodiment of a hair sculpting device.
Figure 5:
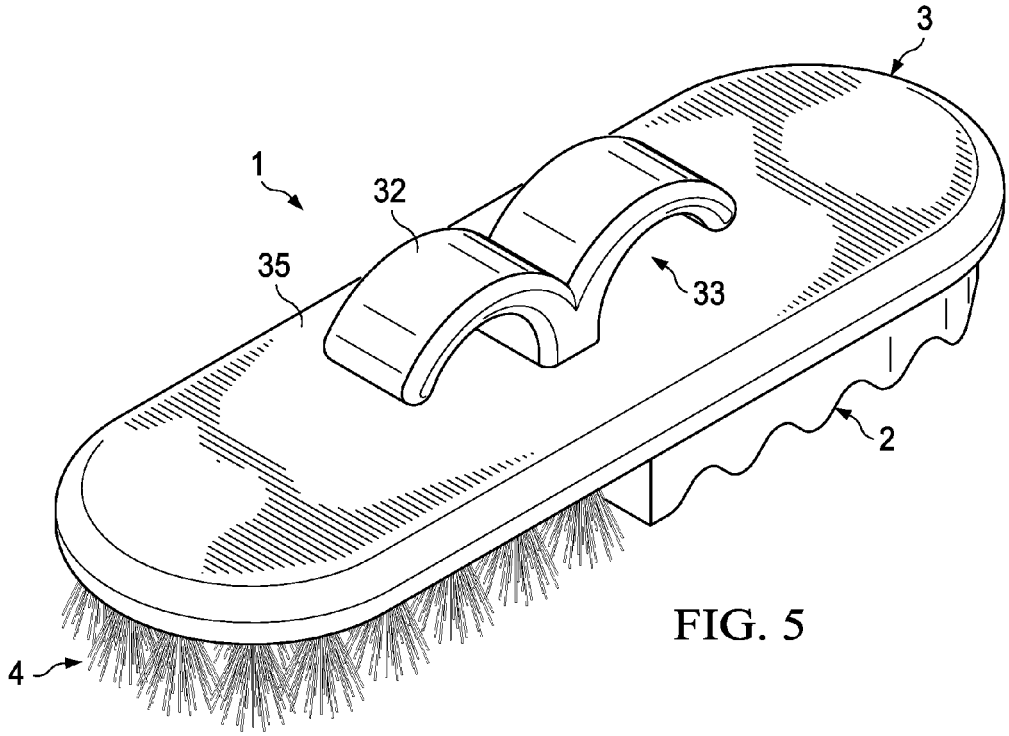
FIG. 5 is a top perspective view of another embodiment of a hair sculpting device.

Now referring to FIGS. 4-5, examples of other embodiments are illustrated. FIG. 4 depicts the device with the top portion (3) comprising curvy-like indentations (31) that are secured to or formed along the upper surface (35), for example, could aide in the application of the device by allowing fingers to be places within each indent or add to the aesthetics of the device. FIG. 5 depicts the device with the top portion (3) comprising a double-hooked appendage (32) secured to the upper surface (35) that, for example, could aide in the gripping and application of the device by allowing fingers to slide into the hook spaces (33) created by the double-hooked appendage (32).

Figure 6:
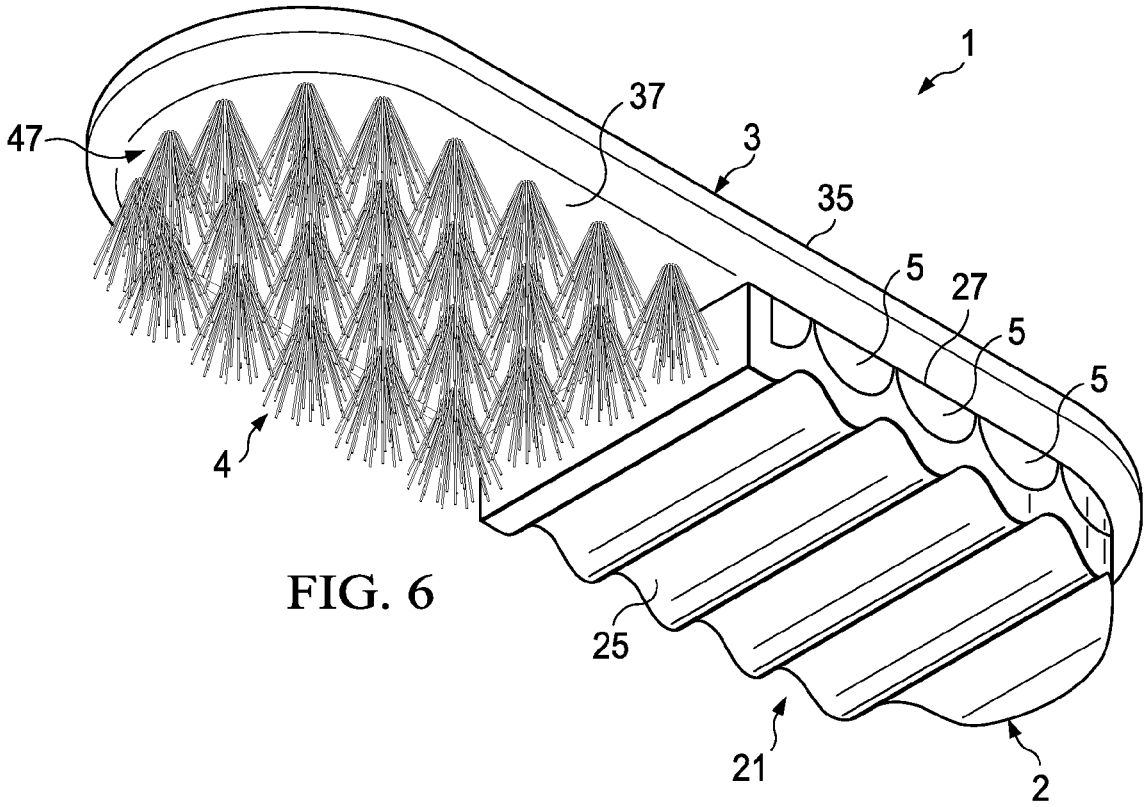
FIG. 6 is a side view of another embodiment of a hair sculpting device.

Now referring to FIG. 6, another embodiment is shown. In addition to the embodiment described previously in FIG. 1, humps (5), or elongated semi-circle-like structures, having a flat side and a curved side are added to the device. The flat side of the humps (5) is secured to the second area (27) of said bottom surface of said top portion (3). The curved side of said humps (5) is secured to said top smooth surface of the groove portion (2). Preferably, divots or notches are carved out of the top smooth surface of the grove portion (2) identical to the shape and size of the humps (5) to allow for a better fit and secureness to the humps (5). Preferably the humps (5) are made of a wood or plastic, but any material that can hold its structure is suitable.

I claim:

1. A hair sculpting device comprising:

a top portion having an upper surface and a bottom surface, a long axis along a length of said device and a short axis along a width of said device, a bristle portion secured to a first portion of said bottom surface, one or more humps having a flat side and a curved side, wherein said flat side of the one or more humps is secured to a second portion of said bottom surface and said curved side is secured to a top smooth surface of a groove portion, a groove portion having a top smooth surface secured to the curved side of said one or more humps and a bottom groove surface, said groove portion having multiple grooves oriented along the short axis along the width of said device and a thickness extending from said bottom groove surface to said top smooth surface, said bristle portion extending downward at least as long as said thickness of said groove portion.

2. The device of claim 1, further comprising a handle secured to said upper surface of said top portion.

3. The device of claim 1, wherein said bristles are slightly longer than the thickness of said groove portion

4. The device of claim 1, wherein said grooves range from 1/10 inch to 1/4 of an inch across.

5. The device of claim 4, wherein said grooves are about 1/8of an inch across.

6. The device of claim 1, wherein said groove portion is comprised of a material block having a first surface secured to said top portion and a second hair-contacting surface having a plurality of integral grooves.

7. The device of claim 6, wherein said material block comprises a foam material.

8. The device of claim 7, wherein said foam material is selected from the group consisting of polyether and polyester based urethane polymers having a density of 0.5-15 lbs/cubic foot.

9. The device of claim 8, wherein said foam is a polyether urethane foam (EU) and has a density of around 2.2 lbs/cubic foot and a compressive strength of around 60-68 pounds per square inch.

10. The device of claim 1, wherein said top portion comprises curvy-like indentions secured to the upper surface.

11. The device of claim 1, wherein said top portion comprises a double-hooked appendage secured to the upper surface.

12. A method for sculpting hair using a hair sculpting device comprising the steps of:

providing a bristle portion and a groove portion, said groove portion having multiple grooves oriented along a short axis along a width of said device, drawing said bristle portion through the hair immediately followed by drawing said groove portion through the hair, whereby said hair is sculpted in a wave hairstyle, and applying a pomade styling product on the user's hair prior to employment of said hair sculpting device.

13. The method of claim 12, further comprising the step of:

donning a stocking-like cap after employment of said hair sculpting device to encourage setting of waves.

14. The method of claim 12, further comprising the step of:

repeating use of said hair sculpting device in additional sessions.

* * * * *